US009876277B2

(12) United States Patent
Liao et al.

(10) Patent No.: US 9,876,277 B2
(45) Date of Patent: Jan. 23, 2018

(54) OMNI DIRECTIONAL CIRCULARLY-POLARIZED ANTENNA

(71) Applicant: Alcatel Lucent, Boulogne Billancourt (FR)

(72) Inventors: Shaowei Liao, Shanghai (CN); Wei Ni, Shanghai (CN); Wei Wang, Shanghai (CN); Gang Shen, Shanghai (CN)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/773,501

(22) PCT Filed: Mar. 4, 2014

(86) PCT No.: PCT/IB2014/000501

§ 371 (c)(1),
(2) Date: Sep. 8, 2015

(87) PCT Pub. No.: WO2014/135970

PCT Pub. Date: Sep. 12, 2014

(65) Prior Publication Data

US 2016/0020511 A1 Jan. 21, 2016

(30) Foreign Application Priority Data

Mar. 8, 2013 (CN) ..... 2013 1 0075104

(51) Int. Cl.
*H01Q 1/50* (2006.01)
*H01Q 1/38* (2006.01)
(Continued)

(52) U.S. Cl.
CPC ..... *H01Q 1/38* (2013.01); *H01Q 1/50* (2013.01); *H01Q 7/00* (2013.01); *H01Q 9/16* (2013.01)

(58) Field of Classification Search
CPC ..... H01Q 1/243; H01Q 1/38; H01Q 21/20; H01Q 1/36
(Continued)

(56) References Cited

U.S. PATENT DOCUMENTS 3,942,180 A * 3/1976 Rannou ..... H01Q 19/06 343/725

FOREIGN PATENT DOCUMENTS

CN 102931479 A 2/2013
KR 10-2011-0005917 A 8/2011
KR 10-2011-0023618 A 10/2012

OTHER PUBLICATIONS

Compact Omnidirectional Antenna of Circular Polarization, IEEE Antenna and Wireless Propagation Letters, vol. 11, pp. 1466-1469, 2012.*

(Continued)

*Primary Examiner* — Dameon E Levi
*Assistant Examiner* — Collin Dawkins
(74) *Attorney, Agent, or Firm* — Fay Sharpe, LLP

(57) ABSTRACT

An omni circularly-polarized antenna comprises: upper and lower layers of metal strips placed horizontally and having identical spoke-like shapes, each of the layers of said metal strips composed of a center and a plurality of spokes connected to the center, the plurality of spokes, at a circumferential position of the spoke-like shape, having extensions extending towards an identical direction along the circumference, wherein extending directions of the extensions of the spokes in the upper and lower layers of metal strips are opposite; metal poles with a number being identical with a number of the spokes in the metal strips, the metal poles vertically interconnecting ends of the extensions of the spokes in the upper and lower layers of metal strips; a coaxial connector comprising an elongated inner conductor and an outer conductor, wherein the elongated inner con- (Continued)

ductor is connected to the center of the upper layer of metal strip, and the outer conductor is connected to the center of the lower layer of metal strip.

9 Claims, 3 Drawing Sheets

(51) Int. Cl.
*H01Q 7/00* (2006.01)
*H01Q 9/16* (2006.01)

(58) Field of Classification Search
USPC ..... 343/860, 799, 895, 730, 769, 908
See application file for complete search history.

(56) References Cited

OTHER PUBLICATIONS

Byung-Chul Park et al., "Omnidirectional Circularly Polarized Antenna Utilizing Zeroth-Order Resonance of Epsilon Negative Transmission Line," IEEE Transactions on Antennas and Propagation, vol. 59, No. 7, pp. 2717-2721, XP011369378, Jul. 7, 2011.
S. D. Ahirwar et al., "Broadband Dual Linear Antenna with Omni Directional Coverage," Applied Electromagnetics Conference, IEEE, pp. 1-4, XP032215115, 2011.
Yufeng Yu et al., "Compact Omnidirectional Antenna of Circular Polarization," IEEE Antennas and Wireless Propagation Letters, vol. 11, pp. 1466-1469, XP011489461, 2012.
International Search Report for PCT/IB2014/000501 dated Sep. 3, 2014.
Yun-Taek Im et al.; "A Spiral-Dipole Antenna for MIMO Systems"; IEEE Antennas and Wireless Propogation Letters, vol. 7, 2008.

* cited by examiner

OMNI DIRECTIONAL CIRCULARLY-POLARIZED ANTENNA

TECHNICAL FIELD

The present invention relates to the technical field of antennas, and particularly to an omni directional circularly-polarized antenna.

BACKGROUND

In recent years, indoor wireless coverage is increasingly becoming a hot spot in the technical field of wireless communications, wherein researches on antenna technologies draw particular concerns in the industry.

The researches up to date have already indicated that due to advantages of circularly-polarized waves compared with linearly-polarized waves, e.g., eliminating multi-path fading and being insensitive to polarization direction, circularly-polarized antennas are widely used in satellite communication and broadcasting. Furthermore, recent work further finds that the circularly-polarized antennas may also be used to enhance indoor coverage because the circularly-polarized antennas are capable of reducing the influence of the polarized direction of a user terminal's antenna on the received signal-to-noise ratio.

However, most of existing circularly-polarized antennas are non-omni directional, e.g., a corner-truncated square patch antenna, a dual/four feed patch antenna and a spiral antenna, etc. Due to their directional radiation patterns, these antennas are not suitable for indoor wireless coverage. Furthermore, these antennas suffer from narrow bandwidth and complex structure.

In FM and TV broadcasting bands, there are several classical types of omni directional circularly-polarized antennas, such as Lindenblad and cycloid dipole antennas. However, if these antennas are scaled down to the commonly-used band (0.8-2.5 GHz) for the indoor wireless coverage, they will be too large in size and very unstable in structure and thereby become unpractical.

Therefore, it is desirable to provide a new omni directional circularly-polarized antenna, which has characteristics such as a wide axis ratio bandwidth and a simple and stable structure, and meanwhile may operate in commonly-used wireless bands to achieve indoor wireless coverage.

SUMMARY OF THE INVENTION

In order to solve the above problems in the prior art, the present invention provides a new omni directional circularly-polarized antenna which uses a vertical short dipole as a part of a feeding network to excite several shunt conducting wires. The wires are placed along an axis of the dipole and together form a loop antenna. A current though the dipole and a current through each of the wires constitute half wave resonance. Therefore, the current through the dipole and the current through each of the wires are inphase. By adjusting a height of the dipole and the number of pieces of shunt conducting wires, horizontal and vertical components of the far-field may be tailored so as to enable an omni directional circularly-polarized radiation.

Specifically, according to one aspect of the present invention, there is provided an omni circularly-polarized antenna, comprising: upper and lower layers of metal strips placed horizontally and having identical spoke-like shapes, each of the layers of metal strips composed of a center and a plurality of spokes connected to the center, the plurality of spokes, at a circumferential position of the spoke-like shape, having extensions extending towards an identical direction along the circumference, wherein extending directions of the extensions of the spokes on the upper and lower layers of metal strips are opposite; metal poles with a number being identical with a number of the spokes on the metal strips, the metal poles vertically interconnecting ends of the extensions of the spokes in the upper and lower layers of metal strips; a coaxial connector comprising an elongated inner conductor and an outer conductor, wherein the elongated inner conductor is connected to the center of the upper layer of metal strip, and the outer conductor is connected to the center of the lower layer of metal strip.

Preferably, the upper and lower layers of metal strips of the antenna are disposed in upper and lower layers of printed circuit boards respectively.

Preferably, the upper and lower layers of metal strips of the antenna are disposed in one layer of printed circuit board.

More preferably, the antenna adjusts a height of the elongated inner conductor and the number of spokes according to its operating frequency.

According to a second aspect of the present invention, there is provided a wireless communication apparatus comprising any one of the above antennas. Preferably, the upper and lower layers of metal strips of the antenna are disposed in one layer of printed circuit board.

Preferably, the apparatus further comprises an external wideband matching network.

According to a third aspect of the present invention, there is provided a wireless communication system comprising the above apparatus.

In the present invention, a simple and practical design of an omni directional circularly-polarized antenna is proposed for indoor coverage. Compared with conventional omni directional circularly-polarized antennas, the proposed antenna has the following two major advantages: first, the whole antenna is mainly based on two printed circuit boards and several metal poles, a structure of which is much simpler than other circularly-polarized antennas, and furthermore, at a higher frequency, the proposed antenna may even be embodied on a single printed circuit board so that the structure proposed in the present invention is easier to be fabricated and more stable; second, a axis ratio bandwidth of the circularly-polarized antenna proposed according to the present invention is far wider than other conventional circularly-polarized antennas.

BRIEF DESCRIPTION OF THE DRAWINGS

Other features, objects and advantages of the present invention will be become more apparent by reading the following detailed description of non-restrictive embodiments with reference to figures.

Wherein identical or like reference numbers denote identical or like step features or means/modules.

DETAILED DESCRIPTION OF THE PREFERRED EMBODIMENT

Reference will be made to the appended figures forming a part of the present invention in the following detailed description of preferred embodiments. The appended figures exemplarily illustrate specific embodiments that may implement the present invention. The exemplary embodiments are not intended to exhaust all embodiments according to the present invention. It may be appreciated that without departure from the scope of the present invention, other embodiments may be used, and structural or logical amendments may be made. Hence, the following detailed depictions are not limitative and the scope of the present invention is defined by the appended claims.

First, according to the electromagnetic theory, far-fields of a vertical short dipole and a horizontal small loop excited by the same current are vertical to each other and have a 90° difference in phase. Thus, by superposing of the two far-fields of the dipole and a loop antenna and adjusting the excitation amplitudes, it is possible to achieve a circularly-polarized radiation field at all directions.

Based on the above theory, a basic idea of this invention is using a dipole as a part of a feeding network to excite several shunt conducting wires which are placed along an axis of the dipole and together form a loop antenna. The current though the dipole and each of the wires constitute half wave resonance. Therefore, the current through the dipole and the current through each of the wires are inphase. By adjusting the height of the dipole and the number of shunt conducting wires, the horizontal and vertical components of the far-field may be tailored, thereby generating an omni directional circularly-polarized radiation.

As may be further seen from the above idea, by adjusting the height of the dipole and the number of shunt conducting wires, the omni directional circularly-polarized antenna according to the present invention may operate in a very wide range of wireless bands, and typically may operate in the commonly-used frequency bands (0.8-2.5 GHz) for indoor wireless coverage; however, the antenna according to the present invention are not limited to the above frequency band. In fact, the antenna according to the present invention may also be applied in millimeter wave band. Hence, the frequency specified in the following depictions is only for the sake of easy description and not intended to limit application scenarios of the present invention.

Figure 1:
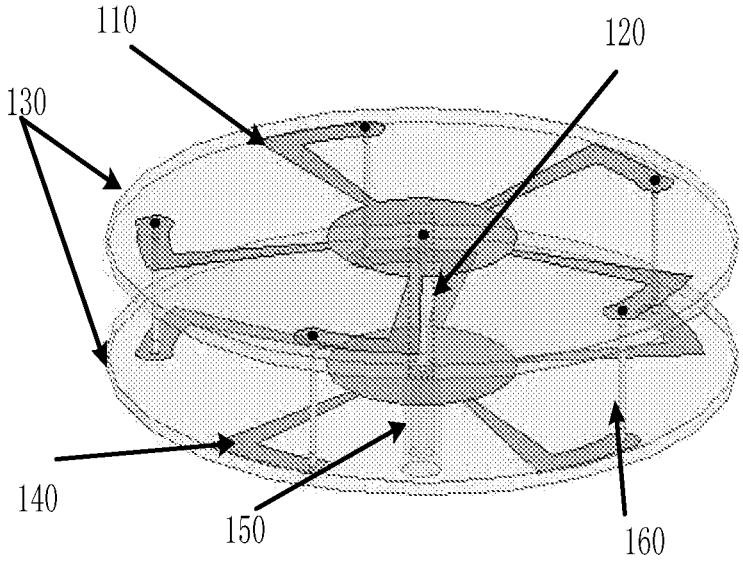
FIG. 1 illustrates a perspective view of an embodiment of an omni directional circularly polarized antenna according to the present invention.
Figure 2:
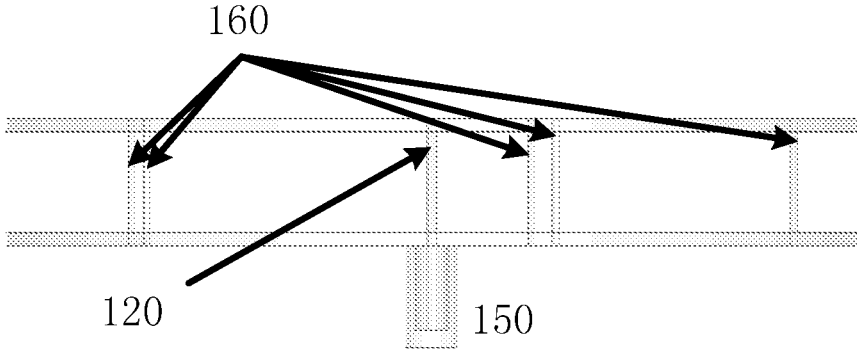
FIG. 2 illustrates a side view of an embodiment of an omni directional circularly-polarized antenna according to the present invention.
Figure 3:
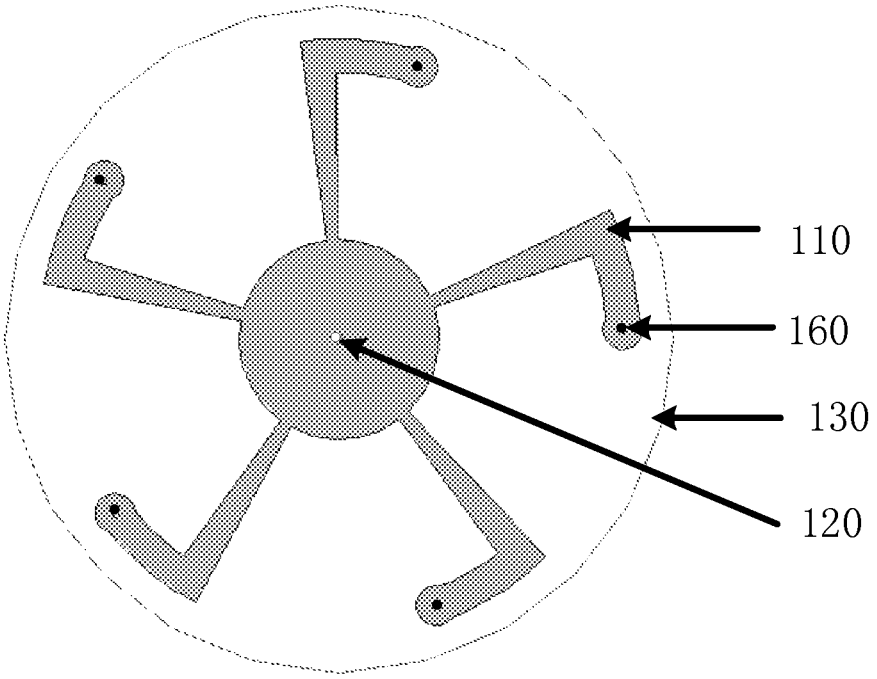
FIG. 3 illustrates a top view of an embodiment of an omni directional circularly-polarized antenna according to the present invention.

FIGS. 1-3 illustrate a specific embodiment of an omni directional circularly-polarized antenna according to the present invention, which may operate at the frequency band of 1.6 GHz.

As shown in the figures, the overall structure are mainly composed of two layers of printed circuit boards 130 respectively having spoke-like metal strips 110, 140. Upper and lower layers of spoke-like metal strips have an identical number of spokes, an end of each spoke has an extension along a circumferential direction, and the extensions in a single layer of metal strips are towards an identical direction; extensions in the upper and lower layers of spoke-like metal strips are in opposite directions. The center of the upper layer of spoke-like metal strip 110 is connected to an elongated inner conductor 120 of a coaxial connector 150; and the center of the lower layer of spoke-like metal strip 140 is connected to an outer conductor of the coaxial connector 150. Several metal poles 160 around the circumference connect top ends of extensions of the spokes in the upper and lower layers of spoke-like metal strips. The current flows from the inner conductor of the coaxial connector 150, then through the elongated inner conductor 120, the upper layer of spoke-like metal strip, the metal poles 160 and the lower layer of spoke-like metal strip 140, and finally returns to the outer conductor of the feeding coaxial connector 150.

The currents in these structures are all inphase as being in a state of half wave resonance. Each pair of spokes in the upper and lower metal strips, which are connected by a metal pole 160, constitute one of the several mentioned shunt conducting wires placed along the axis of the dipole. Extensions of all spokes in the spoke-like metal strips, together, equivalently implement a loop antenna with in-phase excitation. The parts of the spokes in the spoke-like metal strips act as feeding transmission lines for their extensions, because currents of radial parts of each pair of upper and lower spokes are the same in the amplitude and opposite in the direction. This structure generates a far-field direction pattern similar to that generated by a small loop antenna. The elongated inner conductor 120 of the coaxial connector 150 operates as a short dipole on one hand; and on the other hand, it also operates as a part of a feeding structure for the extensions of the spokes in the spoke-like metal strips.

Figure 4:
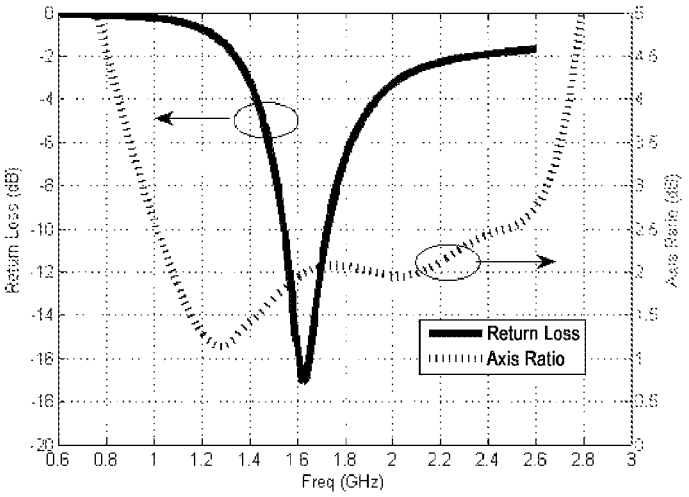
FIG. 4 illustrates a schematic graph of a return loss and maximum axis ratio in an azimuthal plane according to an embodiment of an omni directional circularly-polarized antenna of the present invention.
Figure 5:
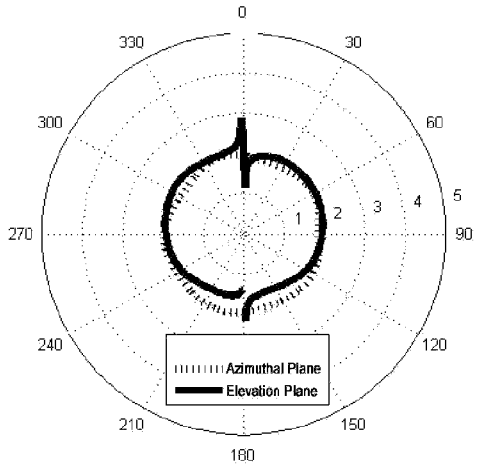
FIG. 5 illustrates a schematic graph of axis ratio in azimuthal and elevation planes at the center frequency according to an embodiment of an omni directional circularly-polarized antenna of the present invention.
Figure 6:
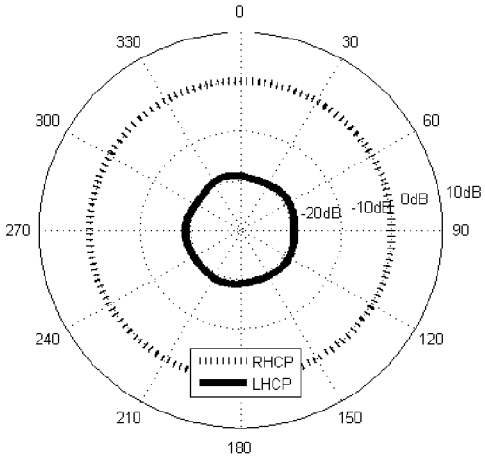
FIGS. 6(*a*) and 6(*b*) illustrate a normalized pattern at the center frequency according to an embodiment of an omni directional circularly-polarized antenna of the present invention.
Figure 6:
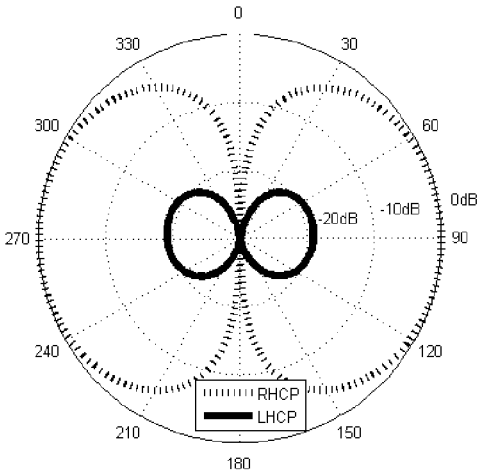

According to the above specific embodiments, an antenna prototype operating at 1.6 GHz has been designed to test advantageous effects of the present invention. The goal of the design is to maintain a low axis ratio in the azimuthal plane, and simultaneously to maximize the impedance and axis ratio bandwidth. The return loss and maximum axis ratio in the azimuthal plane, axis ratio in elevation and azimuthal planes at the center frequency, normalized patterns at the center frequency are respectively given in FIGS. 4 to 6, wherein FIG. 6(*a*) shows an azimuthal plane and FIG. 6(*b*) shows an elevation plane. As shown in the figures, the following may be found:

(1) −10 dB impedance bandwidth is 12.2% (1.54~1.73 GHz) and the 3 dB axis ratio bandwidth is 95% (0.95~2.65 GHz), so the total overlapped bandwidth only depends on the impedance bandwidth;

(2) The pattern is horizontal and omni directional and right-handed circularly-polarization (RHCP);

(3) The axis ratio is lower than =2 dB within the whole plane at the center frequency. The antenna gain at the center frequency is 1.2 dB.

The test results of the above antenna prototype sufficiently indicate that the omni directional circularly-polarized antenna according to the present invention may achieve omni circularly-polarized radiation field with a simple and easy-to-produce structure and a smaller size, and may provide a wider axis ratio bandwidth as compared with conventional circularly-polarized antennas.

Furthermore, the omni directional circularly-polarized antenna according to the present invention may, according to its operating frequencies, adjust the height of the elongated inner conductor 120 and the number of spokes to satisfy different operating frequencies, and thereby may be applied in various wireless frequency bands including millimeter wave bands.

It should be noted that, in the above embodiments, the upper and lower layers of metal strips are located in two layers of printed circuit boards respectively; however, the upper and lower layers of metal strips may also be disposed in one layer of printed circuit board since the height of the elongated inner conductor 120 acting as the short dipole is shorter when the omni directional circularly-polarized antenna according to the present invention operates at a higher frequency.

Correspondingly, the present invention further proposes a wireless communication apparatus which uses the omni directional circularly-polarized antenna according to the present invention.

Further, by adopting other impedance bandwidth broadening techniques, such as an external wideband matching network, the apparatus may further extend the bandwidth.

Correspondingly, the present invention further proposes a wireless communication system which includes the above wireless communication apparatus having the omni directional circularly-polarized antenna according to the present invention.

The above describes embodiments of the present invention, but the present invention is not limited to a specific system, apparatus and specific protocol. Those skilled in the art may make various variations and modifications in the scope defined by the appended claims.

Those having ordinary skill in the art may understand and implement other changes to the revealed embodiments by studying the disclosure of the description, the drawings and the appended claim set. In claims, the term "comprise" does not exclude other elements and steps, and the term "a" does not exclude pluralism. In the present invention, "a first" and "a second" only indicate a name and do not represent a sequential relationship. In practical application of the present invention, a part might perform functions of a plurality of technical features recited in claims. Any reference number in claims shall not be understood as limiting the scope of the disclosure of the present invention.

What is claimed is:

1. An omni directional circularly-polarized antenna, comprising:

upper and lower layers of metal strips placed horizontally and having identical spoke-like shapes, each of the layers of metal strips composed of a center and a plurality of spokes connected to the center, the plurality of spokes, at a circumferential position of the spoke-like shape, having extensions extending towards an identical direction along the circumference, wherein extending directions of the extensions of the spokes in the upper and lower layers of metal strips are opposite;

metal poles with a number being identical with a number of the spokes in the metal strips, the metal poles vertically interconnecting ends of the extensions of the spokes in the upper and lower layers of metal strips;

a coaxial connector comprising an elongated inner conductor and an outer conductor, wherein the elongated inner conductor is connected to the center of the upper layer of metal strip, and the outer conductor is connected to the center of the lower layer of metal strips, the current through the elongated inner conductor and the current through each of said metal poles and each pair of spokes in the upper and lower metal strips which are connected to said metal poles constitute half wave resonance.

2. The antenna according to claim 1, wherein the upper and lower layers of metal strips are disposed in upper and lower layers of printed circuit boards, respectively.

3. The antenna according to claim 1, wherein the upper and lower layers of metal strips are disposed in one layer of printed circuit board.

4. The antenna according to claim 1, wherein a height of the elongated inner conductor and the number of the spokes are adjusted according to an operating frequency of the antenna.

5. A wireless communication apparatus comprising the antenna according to claim 1.

6. The wireless communication apparatus according to claim 5, further comprising an external wideband matching network.

7. A wireless communication system comprising the apparatus according to claim 5.

8. An omni directional circularly-polarized antenna, comprising:

upper and lower layers of metal strips placed horizontally and having identical spoke-like shapes, each of the layers of metal strips composed of a center and a plurality of spokes connected to the center, the plurality of spokes, at a circumferential position of the spoke-like shape, having extensions extending towards an identical direction along the circumference, wherein extending directions of the extensions of the spokes in the upper and lower layers of metal strips are opposite;

metal poles with a number being identical with a number of the spokes in the metal strips, the metal poles vertically interconnecting ends of the extensions of the spokes in the upper and lower layers of metal strips;

a coaxial connector comprising an elongated inner conductor and an outer conductor, wherein the elongated inner conductor is connected to the center of the upper layer of metal strip, and the outer conductor is connected to the center of the lower layer of metal strips, wherein the height of the elongated inner conductor and the number of spokes are adjusted according to an operating frequency of the antenna.

9. A wireless communication apparatus, comprising:

an external wideband matching network; and an omni directional circularly-polarized antenna, wherein the antenna is comprised of upper and lower layers of metal strips placed horizontally and having identical spoke-like shapes, each of the layers of metal strips composed of a center and a plurality of spokes connected to the center, the plurality of spokes, at a circumferential position of the spoke-like shape, having extensions extending towards an identical direction along the circumference, wherein extending directions of the extensions of the spokes in the upper and lower layers of metal strips are opposite;

metal poles with a number being identical with a number of the spokes in the metal strips, the metal poles vertically interconnecting ends of the extensions of the spokes in the upper and lower layers of metal strips; and a coaxial connector comprising an elongated inner conductor and an outer conductor, wherein the elongated inner conductor is connected to the center of the upper layer of metal strip, and the outer conductor is connected to the center of the lower layer of metal strips.

* * * * *